United States Patent [19]

Osborne

[11] 3,971,394

[45] July 27, 1976

[54] APPARATUS FOR CLEANING VEHICLE PARTS

[76] Inventor: Irving R. Osborne, 1602 Rockefeller, Everett, Wash. 98201

[22] Filed: Apr. 28, 1975

[21] Appl. No.: 572,156

[52] U.S. Cl. ..... 134/104; 134/111; 134/141; 210/167

[51] Int. Cl.[2] ..... B08B 3/02; B08B 3/10

[58] Field of Search ..... 134/10, 13, 104, 109, 134/111, 140–141; 210/167

[56] References Cited

UNITED STATES PATENTS

| | | | |
|---|---|---|---|
| 2,595,838 | 5/1952 | Fuglie | 134/111 |
| 3,269,397 | 8/1966 | Woods | 134/141 |
| 3,707,404 | 12/1972 | Carlson et al. | 134/109 X |
| 3,890,988 | 6/1975 | Lee | 134/111 |

*Primary Examiner*—Robert L. Bleutge
*Attorney, Agent, or Firm*—Seed, Berry, Vernon & Baynham

[57] ABSTRACT

An apparatus for cleaning vehicle parts includes a reservoir containing a lower layer of water and an upper layer of solvent, a fluid pump for conveying solvent from the solvent layer to the parts to remove dirt and grease therefrom, a solvent collector for feeding the used solvent to a plurality of sequentially arranged settling tanks and a filter for receiving the solvent from the settling tanks and removing suspended particles therefrom. The solvent passes through the filter and the filtered solvent is discharged into the water layer of the reservoir. The lighter-than-water solvent rises to the solvent layer, leaving particulate matter behind in the water layer.

4 Claims, 5 Drawing Figures

APPARATUS FOR CLEANING VEHICLE PARTS

BACKGROUND OF THE INVENTION

1. Field of the Invention

This invention relates to a washer for vehicle parts and, more particularly, to a washer using a recirculated solvent which is cleansed each recirculation cycle.

2. Description of the Prior Art

In vehicle repair shops, it is often necessary to clean dirt and grease from parts removed from vehicles undergoing repair. These parts must be cleansed with a solvent capable of removing oil and grease from the parts. Before the part can be reinstalled in the vehicle, virtually all of the dirt and grease must often be removed therefrom. For example, vehicle wheel bearings removed from a vehicle must be repacked with grease or other lubricant. However, all of the dirt and grease must first be removed from the bearing surfaces. This task has been conventionally accomplished by washing the parts with a series of fresh solvent batches. However, this procedure is extremely wasteful since is requires at least one fresh batch of solvent for each vehicle part. Since the solvent is somewhat expensive and is not easily disposed of, the conventional method of washing parts is unacceptable. One solution for the problems associated with the conventional parts cleaning method is to recirculate the solvent. The recirculated solvent is then cleansed during each recirculation cycle. Filtering is one possible cleansing method. However, the large amount of dirt and grease removed from the parts quickly clogs up the filter. The solvent may also be cleansed by holding the used solvent in a settling basin wherein the heavier-than-solvent particles drop to the bottom of the basin. The relatively clean solvent is subsequently removed from the basin and reused. However, this method removes only heavier-than-solvent particles; particles suspended in the solvent flow out of the basin with the solvent.

SUMMARY OF THE INVENTION

It is an object of the invention to provide a stream of clean solvent for washing dirt and grease from vehicle parts.

It is another object of the invention to recirculate the solvent so that the vehicle parts are inexpensively cleaned.

It is still another object of the invention to effectively remove dirt and grease from the used solvent, thereby prolonging the life of the solvent.

These and other objects of the invention are accomplished by a parts washer which recirculates the solvent and which cleanses the solvent each recirculation cycle. The cleansing is accomplished by collecting the used solvent and conveying it to an inclined settling trough having a plurality of settling tanks. Solvent flows sequentially from the upper settling tanks to the lower settling tank, leaving behind particulate matter which settles to the bottom of each tank. The solvent flows from the lower settling trough, passes through a filter, and is discharged into a layer of water located beneath a layer of solvent. The lighter-than-water solvent floats to the solvent layer, leaving particulate matter behind in the water layer.

DETAILED DESCRIPTION OF THE INVENTION

Figure 1:
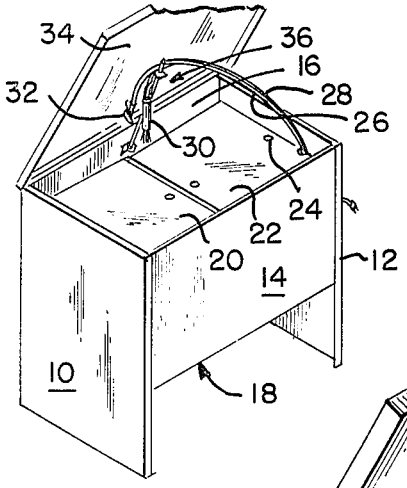
FIG. 1 is an isometric view showing the parts washer with the collection surfaces installed.
Figure 2:
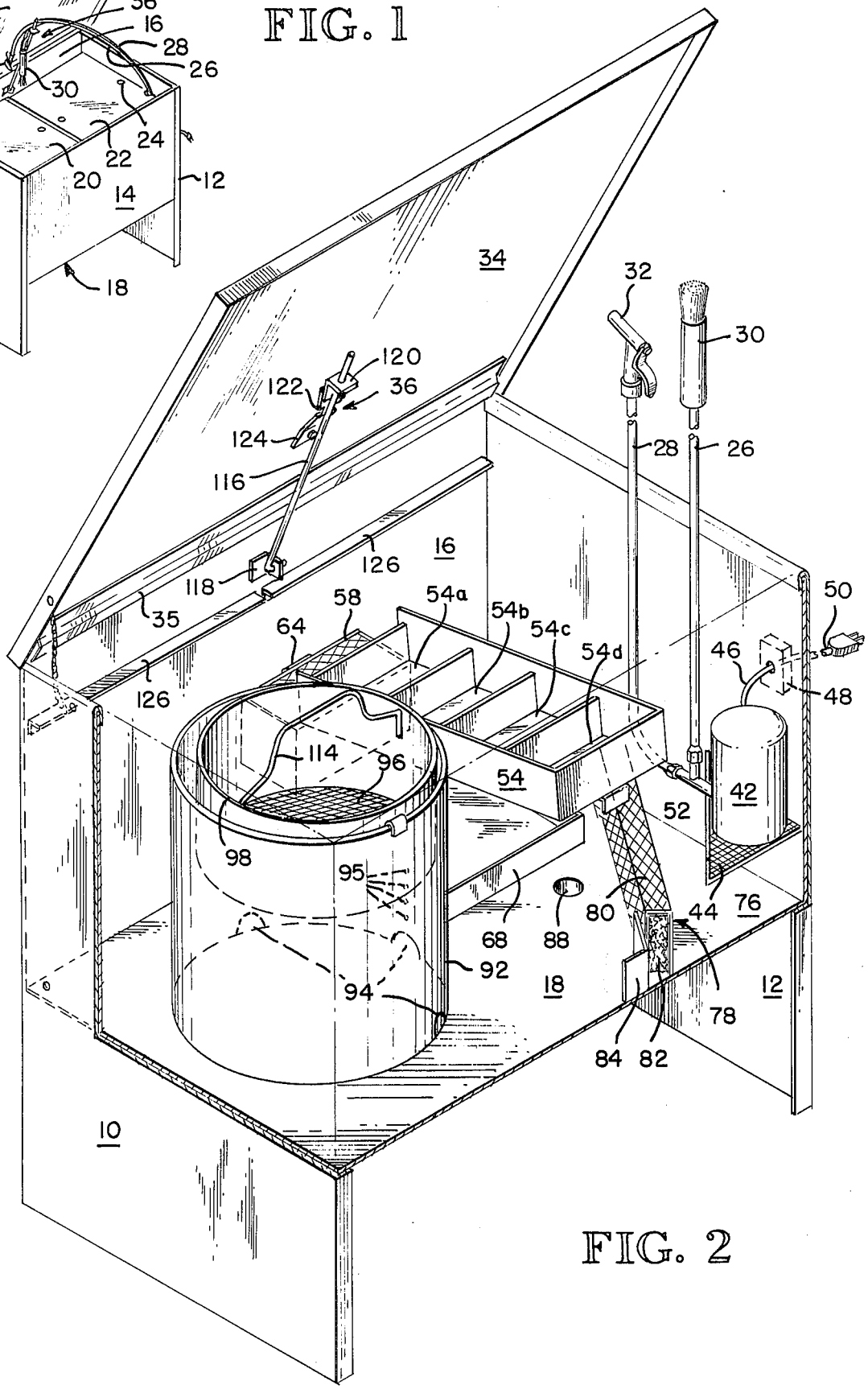
FIG. 2 is a fragmented isometric view showing the internal structure of the vehicle washer.

The inventive vehicle parts washer, as shown in FIGS. 1 and 2, includes a generally rectangular tank having sidewalls 10, 12 which extend to the floor, a front wall 14, a rear wall 15 and a bottom 18. The tank is covered at the top by a pair of inwardly inclined collection surfaces 20, 22 separated from each other at the center by a small amount. The collection surfaces 20, 22 contain apertures 24 through which a finger may be inserted to allow the surfaces 20, 22 to be lifted from the tank. The vehicle parts are held above the surfaces 20, 22, and the solvent is conveyed to the parts by a pair of hoses 26, 28 terminating, respectively, in a washing brush 30 and a rinsing nozzle 32. The tank may be enclosed by a cover 34 pivotally fastened to the rear wall 16 by a piano hinge 35. While the washer is in operation, the cover 34 is held in a raised position by a fusable link 36 which allows the cover 34 to drop in the event of a fire in the tank.

Figure 3:
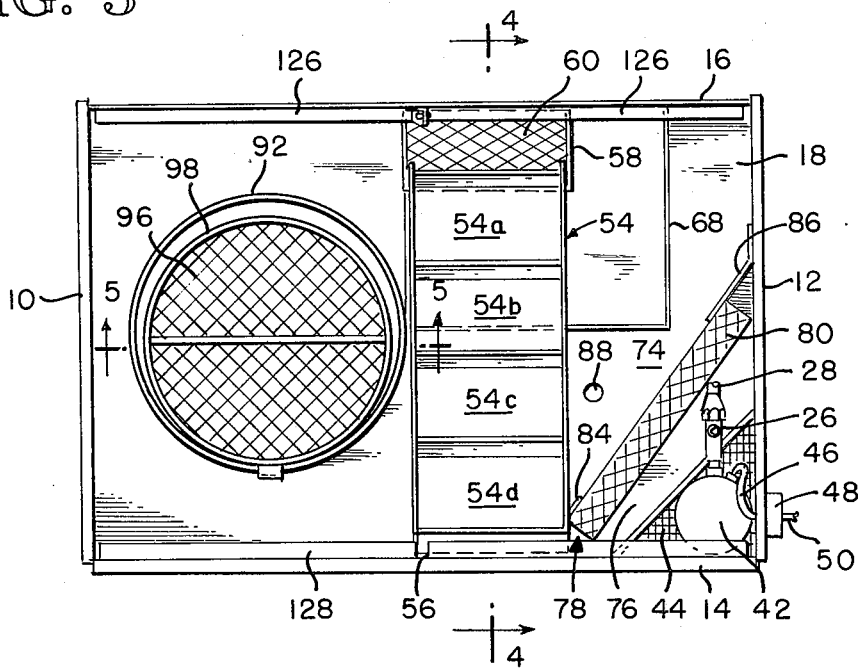
FIG. 3 is a top plan view of the vehicle washer with the cover removed.
Figure 4:
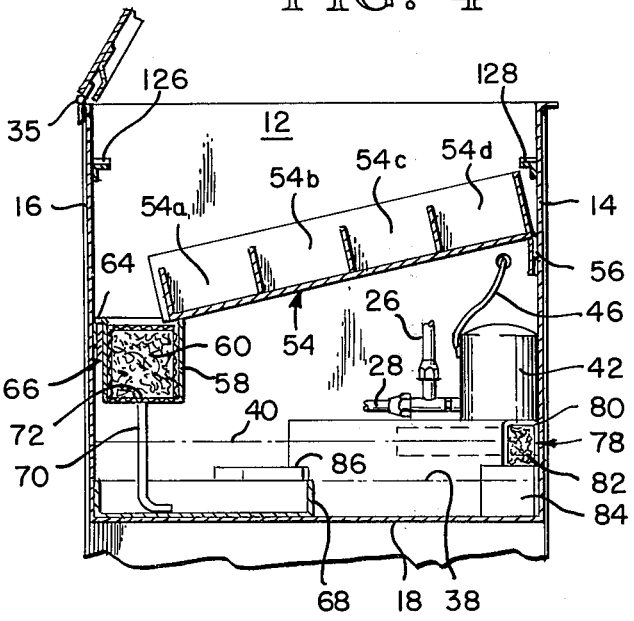
FIG. 4 is a cross-sectional view taken along the line 4—4 of FIG. 3.

The internal details of the washer are best illustrated in FIGS. 2, 3 and 4. Initially, the tank is filled with about two inches of water 38 (FIG. 4), and a predetermined quantity of solvent 40 is then added to the tank. A fluid pump 42 having a bottom inlet port (not shown) is mounted on a filter screen 44 beneath the level of the solvent 40, but above the level of the water 38. Thus, in normal operation, the pump 42 draws solvent 40, and not water 38, from the tank. The pump 42 is driven by an internal motor (not shown) which is supplied with power through wires 46 when a control switch 48 is in its "on" position. Power is supplied to the switch 48 through a conventional power cord 50. The outlet port (not shown) of the fluid pump 42 communicates with a T-conduit 52 for conveying solvent to the wash hose 26 and the rinse hose 28. As mentioned earlier, the hoses 26, 28 carry the solvent to the washing brush 30 and the rinsing nozzle 32 which may be moved about above the collection surfaces 20, 22 to wash and rinse the vehicle part. The used solvent flows down the inclined collection surfaces 20, 22 toward the center of the tank and falls therebetween into an inclined settling trough 54. The settling trough includes a plurality of transverse barriers having a height less than that of the sidewalls which divide the trough into a plurality of settling chambers 54*a–d.* The barriers maintain the level of fluid in each chamber and allow fluid to flow sequentially from the upper chambers to the lower chamber 54*a.* A horizontal bracket 56 is welded to the inside of the front wall 14 and receives a downwardly projecting extension of the top end wall of the trough 54. The bracket 56 prevents both axial and vertical movement of the settling trough 54. The lower settling chamber 54*a* rests on the top surface of a filter tank 58. The trough 54 may be easily removed from the tank for disposing of collected particles by disengaging the trough 54 from the brackets and lifting. Fluid flows over the lower end wall of the settling trough 54 and enters the tank 58 through its open top. The interior of the filter tank 58 is filled with a suitable filter material 60 which traps suspended particles which have not settled out in the settling trough 54. The rear end wall of the filter tank 58 contains a hanger 64 which fits over a bracket 66 which is welded to the rear wall 16 of the washer. The filter tank 58 may be easily removed from the bracket 66 to facilitate removal of spent filter material 60. Solvent passes through the filter material 60 and is discharged at the bottom of a settling tray 68 by a tube 70 connected to a bottom port 72 in the filter tank 58. The settling tray 68 has a bottom and sidewalls which extend upwardly approximately to the level of the water 38. The solvent entering the chamber 68 rises to the solvent level while particulate matter is retained by the water in the tray 68 and settles to the bottom of the tray 68, either immediately or after remaining at the water-solvent interface for a time. The tray is periodically emptied of particulate matter by removing it from the bottom 18 of the tank and dumping it.

The bottom 18 of the tank is divided into two sections 74, 76 by a filter barrier 78 formed by a U-shaped screen 80 filled with a suitable filter mterial 82. The filter barrier 78 extends from the front wall 14 to the right sidewall 12 of the washer. The open side of the barrier 78 abuts the bottom of the tank 18 along the entire length of the barrier 78. It is held in position by a pair of mounting brackets 84, 86 which are welded, respectively, to the front wall 14 and sidewall 12 of the washer. The filter barrier 78 is wedged between the bracket 84 and front wall 14 and between the bracket 86 and the sidewall 12. The frictional fit thereby provided holds the barrier 78 in place while allowing the filter barrier 78 to be lifted from the tank in order to replace spent filter material 82. Fluid passing from tank section 74 to tank section 76 must pass through the filter barrier 78. The bottom of the tank 18 contains drain port 88 which is normally stopped up by a suitable means (not shown). The port 88 is opened for draining the tank when the solvent has accumulated an undesirable quantity of dirt and grease.

Figure 5:
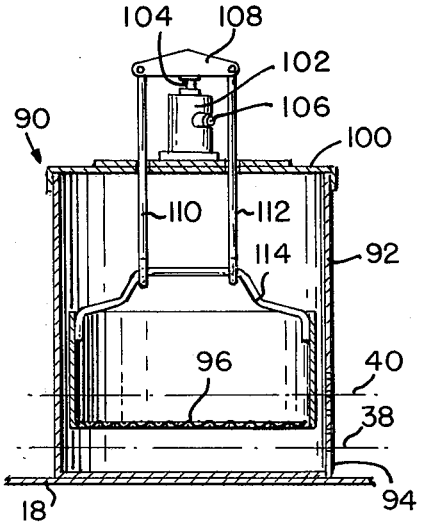
FIG. 5 is a cross-sectional view of the agitating tank used in the vehicle washer taken along the line 5—5 of FIG. 3.

The washer also contains an agitator 90 for automatically washing vehicle parts. The agitator 90 includes a generally cylindrical tank 92 having a plurality of semicircular discharge ports 94 at the bottom communicating with the tank section 74 beneath the water level 38. A series of vertically aligned holes 95 through the tank sidewall maintain the water and solvent levels within the tank 92 the same as in tank section 74. A basket having a porous bottom 96 and cylindrical sidewalls 98 is positioned in the tank 92 with the bottom 96 at the approximate center of the solvent layer 40, as best seen in FIG. 5. The tank 92 is covered by a top cover 100 having a standard SPRAGUE reciprocating acutator 102 mounted thereon. The actuator 102 contains an upstanding axial shaft 104 which, when the actuator is driven by pressurized air through port 106, reciprocates up and down. The shaft 104 is connected to a support plate 108 which is, in turn, connected to a pair of support shafts 110, 112. The lower ends of the support shafts 110, 112 are bent upwardly to receive a handle 114 rigidly secured to the sidewalls 98 of the basket. The actuator 102 vertically reciprocates the basket, with the parts (not shown) resting on the porous bottom 96 and in the solvent layer 40 at all times.

The reciprocating action in the solvent causes the solvent to sweep dirt out of the tank 92 into the water layer 38 through the discharge ports 94.

The fusable link 36 which supports the cover 34 includes a bar 116 (FIG. 2) having a bent lower end which is pivotally connected to the rear wall 16 of the washer through a bracket 118. The top end of the bar 116 is fixedly connected to a link 120 which is connected through a fuse link 122 to a bracket 124 welded to the cover 34. The fuse link 122 melts at a relatively low temperature. Thus, in the event of a fire in the tank, the fuse link 122 melts, separating the link 120 from the bracket 124 and allowing the bar 116 and cover 34 to pivot downwardly.

As best seen in FIGS. 1 and 2, the collection surfaces 20, 22 are supported by brackets 126 and 128, welded, respectively, to the rear wall 16 and front wall 14 of the washer. The brackets 126, 128 are inclined downwardly toward the center to cause solvent collected by the surfaces 20, 22 to flow toward the center.

In operation, the collection surfaces 20, 22 are mounted in the washer, and the switch 48 is actuated to supply power to the hydraulic pump 42, which then delivers solvent to the washing brush 30 and rinsing nozzle 32. Initially, the washing brush 30 is brushed against the part to dislodge dirt and grease until substantially all the dirt and grease have been removed therefrom. The rinsing nozzle 32 is then used to remove the remaining particulate matter from the part. The used solvent flows onto the collection surfaces 20, 22 and drops into the settling trough 54 through the aperture between the collection surfaces 20, 22. The solvent flows downwardly in the trough 54 to the bottom chamber 54*a*, leaving behind suspended particles which are heavier than the solvent. Since the solvent has a relatively low specific gravity, most of the particles will be left behind. From the settling trough 54, the solvent flows into the filter tank 58 wherein particles suspended in the solvent are removed. The filtered solvent is then discharged at the bottom of the settling tray 68 by the tube 70. The solvent rises to the solvent layer, leaving behind any additional particles still present in the solvent. Subsequently, the solvent flows through the filter barrier 78 and is once again delivered to the washing brush 30 or rinsing nozzle 32 by the pump 42. The settling trough 54 is periodically lifted from the brackets 56, and the settled-out particles are removed therefrom. Similarly, the filter tank 58 is periodically removed from the bracket 66 and the filter material 60 therein is changed, and the settling tray 68 is periodically emptied. After the solvent has been in use for a relatively long period of time, the solvent and water are drained from the tank through the drain port 88 and a new batch of water and solvent is added to the tank.

Alternately, the parts may be washed by placing them in the basket and connecting a source of pressurized air to the air port 106 in the actuator 102. The reciprocating action of the shaft 104 moves the parts up and down within the solvent 40, continuously removing dirt and grease therefrom. When the parts are removed from the agitator 90, they may be rinsed with the rinsing nozzle 32 if desired.

The vehicle parts washer of the present invention inexpensively removes dirt and grease from vehicle parts by recirculating the solvent and subjecting the solvent to several cleansing steps incident to each recirculation cycle.

The embodiments of the invention in which a particular property or privilege is claimed are defined as follows:

1. A washer for vehicle parts, comprising:

a tank containing a layer of water and a layer of lighter-than-water solvent;

a fluid pump having an inlet port positioned in said solvent layer for receiving solvent therefrom and an outlet port conveying solvent through a solvent supply conduit to a utilization point;

collection means beneath the utilization point for conveying solvent discharged from said solvent supply conduit after said solvent has washed the parts;

a plurality of inclined, sequentially arranged settling tanks receiving the solvent from said collection means;

a filter positioned adjacent the lower settling tank and receiving the solvent flowing therefrom, said filter tank containing a filter material, a discharge port beneath said filter material and a tube connected to said discharge port opening into said water layer; and a filter barrier dividing said tank into two compartments, a first compartment receiving the contents of said filter tank and a second compartment communicating with said fluid pump inlet port whereby recirculated solvent sequentially flows through said filter barrier, pump, collection means, settling tanks, filter tank and water layer.

2. The apparatus of claim 1 wherein a settling tray is placed in said first compartment for receiving the discharge from said filter tank whereby particulate matter discharged from said tank is collected in said settling tray.

3. The apparatus of claim 1 wherein said filter barrier comprises an elongated, U-shaped screen extending from one tank wall to an adjoining tank wall and removable therefrom, said screen having its open side positioned downwardly against the bottom of the tank and its interior filled with a filtering material.

4. The apparatus of claim 1 further comprising:

a basket having a porous bottom and a handle;

an agitating tank positioned in said solvent tank for receiving said basket with said porous bottom in said solvent layer, said agitating tank having an opening through the bottom of the tank sidewall beneath said water layer;

support means for positioning said basket in said agitating tank with the porous bottom in said solvent; and reciprocating actuator means secured to said support means for repeatedly moving the parts in said basket up and down in said solvent.

* * * * *